US011305156B2

(12) United States Patent
Yamada

(10) Patent No.: US 11,305,156 B2
(45) Date of Patent: Apr. 19, 2022

(54) FOOT EXERCISE DEVICE

(71) Applicant: Spencer Fumio Yamada, Provo, UT (US)

(72) Inventor: Spencer Fumio Yamada, Provo, UT (US)

( * ) Notice: Subject to any disclaimer, the term of this patent is extended or adjusted under 35 U.S.C. 154(b) by 42 days.

(21) Appl. No.: 16/719,837

(22) Filed: Dec. 18, 2019

(65) Prior Publication Data

US 2021/0086028 A1 Mar. 25, 2021

Related U.S. Application Data

(60) Provisional application No. 62/904,190, filed on Sep. 23, 2019.

(51) Int. Cl.
*A63B 23/10* (2006.01)
*A61H 1/02* (2006.01)

(52) U.S. Cl.
CPC ..... *A63B 23/10* (2013.01); *A61H 1/0266* (2013.01)

(58) Field of Classification Search
CPC ..... A63B 21/00178; A63B 21/002; A63B 21/0023; A63B 21/012; A63B 21/015; A63B 21/22; A63B 21/4015; A63B 21/4034; A63B 23/04; A63B 23/08; A63B 23/085; A63B 23/10; A61H 1/0266
See application file for complete search history.

(56) References Cited

U.S. PATENT DOCUMENTS 1,509,793 A 9/1924 Thompson
1,546,506 A * 7/1925 Naysmith ..... A61H 1/0266 606/237
1,801,769 A 4/1931 Gartner
2,016,930 A 10/1935 Mccahan
2,664,886 A * 1/1954 Coffman ..... A61F 5/04 602/15
2,760,774 A * 8/1956 Perez ..... A63B 21/4015 482/79
3,088,458 A 5/1963 Stewart
3,134,591 A * 5/1964 Conn, Jr. ..... A63B 22/14 482/147
4,186,920 A 2/1980 Fiore et al.
4,337,939 A 7/1982 Hoyle et al.
4,461,472 A * 7/1984 Martinez ..... A63B 23/10 482/128

(Continued)

OTHER PUBLICATIONS

International Search Report and Written Opinion dated Dec. 21, 2020, on application No. PCT/US20/50379.

(Continued)

*Primary Examiner* — Nyca T Nguyen
*Assistant Examiner* — Zachary T Moore
(74) *Attorney, Agent, or Firm* — Lowenstein Sandler LLP

(57) ABSTRACT

A foot exercise device is described. In some embodiments, a foot exercise device includes a base structure and a forefoot structure coupled to the base structure. The base structure is configured to remain stationary. The forefoot structure is configured to be moved by a forefoot of a user while the base structure remains stationary. In some embodiments, a foot exercise device includes a base structure and a heel structure coupled to the base structure. The base structure is configured to remain stationary. The heel structure is configured to be moved by a heel of the user while the base structure remains stationary.

16 Claims, 7 Drawing Sheets

(56) References Cited

U.S. PATENT DOCUMENTS

| | | | | |
|---|---|---|---|---|
| 4,461,474 | A | 7/1984 | Retzlaff | |
| 4,650,183 | A | 3/1987 | McIntyre | |
| 4,822,027 | A * | 4/1989 | Kascak | A63B 21/0552 482/130 |
| 4,842,265 | A | 6/1989 | Kirk | |
| 4,967,736 | A | 11/1990 | Spitzer | |
| 5,087,036 | A * | 2/1992 | Cooper | A63B 23/085 482/79 |
| 5,611,770 | A * | 3/1997 | Tesch | A61H 1/0266 482/131 |
| 5,643,164 | A | 7/1997 | Teff | |
| 5,891,002 | A | 4/1999 | Maki | |
| 6,393,736 | B1 | 5/2002 | Greer, Jr. et al. | |
| 6,834,397 | B1 | 12/2004 | Murphy | |
| 7,766,801 | B2 | 8/2010 | Campanaro et al. | |
| 7,874,996 | B2 * | 1/2011 | Weinstein | A61H 1/0266 601/27 |
| 9,282,786 | B2 | 3/2016 | Farrell | |
| 9,364,382 | B1 * | 6/2016 | Cooper | A61H 1/0266 |
| 9,446,288 | B1 | 9/2016 | Pazan | |
| 9,914,009 | B2 * | 3/2018 | Tarkington | A63B 21/02 |
| 10,245,466 | B2 | 4/2019 | Uygan | |
| 10,434,357 | B2 * | 10/2019 | McCarthy | A63B 21/0552 |
| 2004/0023764 | A1 | 2/2004 | Repking | |
| 2005/0131324 | A1 | 6/2005 | Bledsoe | |
| 2007/0037672 | A1 | 2/2007 | Nakanishi | |
| 2009/0270231 | A1 * | 10/2009 | Hall | A63B 21/4015 482/79 |
| 2010/0228169 | A1 * | 9/2010 | Ootani | A61H 15/00 601/118 |
| 2010/0317495 | A1 | 12/2010 | DiGiovanni et al. | |
| 2011/0152041 | A1 | 6/2011 | Francis | |
| 2014/0100086 | A1 | 4/2014 | Pagliaro | |
| 2019/0070459 | A1 | 3/2019 | Michaud | |
| 2019/0091090 | A1 | 3/2019 | Koskela | |

OTHER PUBLICATIONS

McKeon, Patrick O., et al., "The Foot Core System: A New Paradigm for Understanding Intrinsic Foot Muscle Function", BR J Sports Med. 2015;49:290. doi:10.1136/bjsports-2013-092690, Mar. 21, 2014, pp. 1-9.

* cited by examiner

FOOT EXERCISE DEVICE

RELATED APPLICATION

This application claims benefit of U.S. Provisional Patent Application 62/904,190, filed Sep. 23, 2019, the entire content of which is incorporated by reference herein.

TECHNICAL FIELD

Embodiments of the present disclosure relate to an exercise device, and in particular to a foot exercise device.

BACKGROUND

Many people are affected by leg and/or foot pain. Leg and/or foot pain may be caused by injury, age, sedentary lifestyle, type of footwear, or the like. People with leg and/or foot pain may be instructed to use external foot support or to perform calf and/or toe strengthening exercises to attempt to relieve pain.

BRIEF DESCRIPTION OF THE DRAWINGS

The present disclosure is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

DETAILED DESCRIPTION OF EMBODIMENTS

Figure 1:
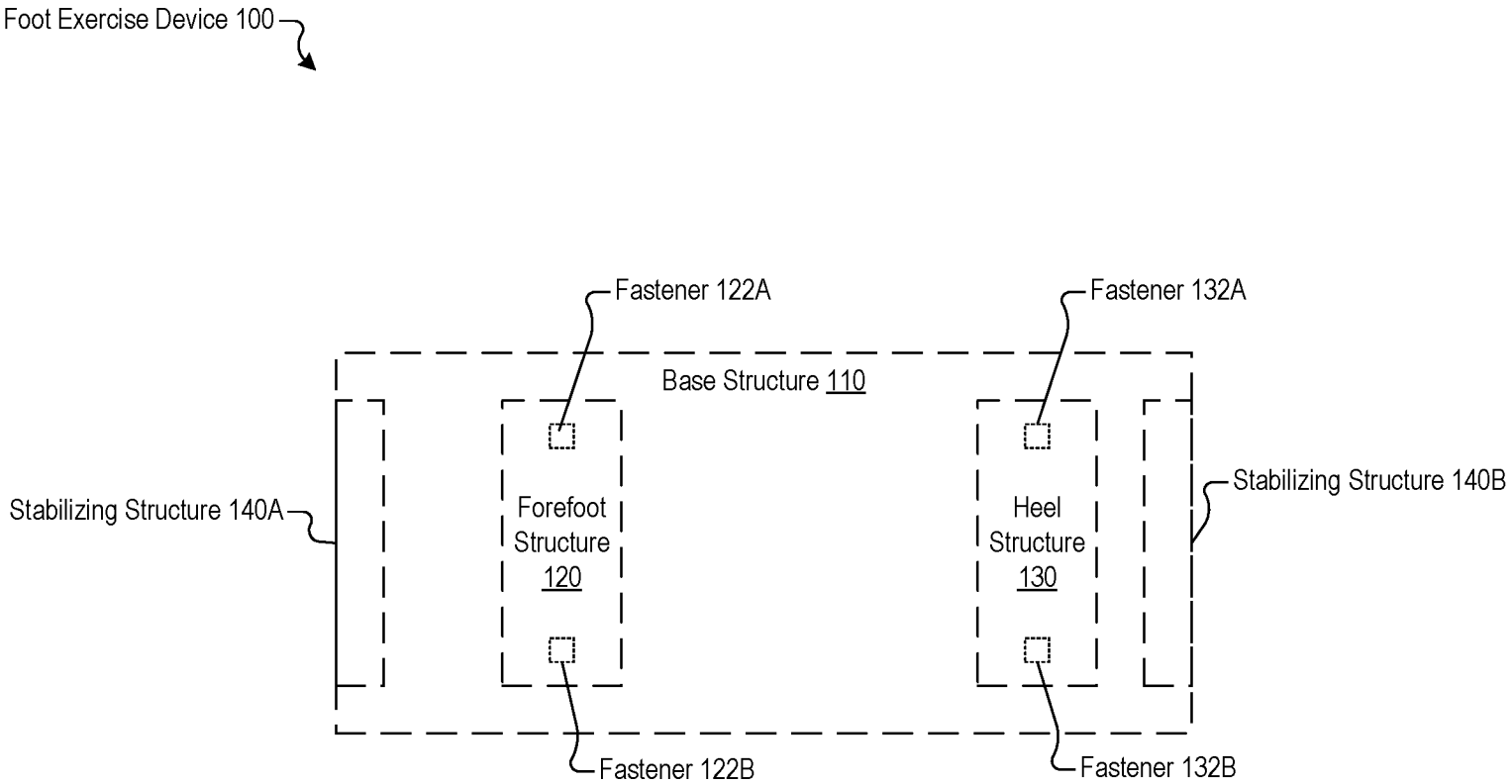
FIG. 1 illustrates a top view of foot exercise device, according to certain embodiments.

Embodiments described herein are related to a foot exercise device. The foot is one of the most complex structures in the human body. The foot is made up of over one hundred moving parts including bones, muscles, tendons, and ligaments that are designed to allow feet to balance the body's weight on two legs and support diverse actions such as running, jumping, climbing, walking, and the like. The foot has many articulations and multiple degrees of freedom that play an important role in static posture and dynamic activities. For example, during standing, the foot provides a base of support and during gait, the foot is to be stable at foot-strike and push-off. During mid-support, the foot is to be a mobile adaptor and attenuate loads. The foot also possesses spring-like characteristics, storing and releasing elastic energy with each foot-strike through deformation of the arch, which is controlled by intrinsic and extrinsic foot muscles. The stability of the arch (e.g., the central core of the foot) is needed for normal foot function. Because feet are so complicated and support such diverse actions, human feet are prone to injury and/or causing pain. The human leg is connected to the foot and is also complicated and supports diverse actions. Human legs can also be prone to injury and causing of pain.

A particular part of the foot or leg may be the cause of pain. For example, parts of the body that may cause pain include flexor hallucis brevis, flexor digitorum longus, posterior tibialis (e.g., tibialis posterior muscle), plantar fascia (e.g., plantar aponeurosis), or the like. The flexor hallucis brevis is a muscle of the foot that flexes the big toe. The flexor digitorum longus is a muscle that is used to curl the second, third, fourth, and fifth toes (e.g., runs from the calf to the foot and divides into four individual tendons for the second to fifth toes). The posterior tibialis is a muscle that is used for stabilization, contracts to produce inversion, assists in the plantar flexion of the foot at the ankle, and supports the medial arch of the foot (e.g., runs form the calf to the foot). The plantar fascia is a thick connective tissue (e.g., aponeurosis) that supports the arch on the bottom (e.g., plantar side) of the foot. The plantar fascia runs from the heel region of the foot (e.g., from the tuberosity of the calcaneus (e.g., heel bone), from the medial calcaneal tubercle) forward to the toe region of the foot (e.g., to the heads of the metatarsal bones (e.g., bone between each toe and the bones of the mid-foot), proximal phalanges of the toes). The plantar fascia may contribute to support of the arch of the foot by acting as a tie-rod, where the plantar fascia undergoes tension when the foot bears weight (e.g., carrying up to about 14% of the total load of the foot). The plantar fascia has an important role in dynamic function during gait (e.g., walking, jogging, skipping, running, sprinting, or the like). The plantar fascia may be continuously elongated during contact phase of gait and may go through rapid elongation before and immediately after mid-stance, reaching a maximum of about 9% to about 12% elongation between mid-stance and toe-off. During this phase, the plantar fascia may behave like a spring, assisting in conserving energy. The flexor hallucis brevis, flexor digitorum longus, posterior tibialis, and/or plantar fascia may also have other important roles. One or more of the flexor hallucis brevis, flexor digitorum longus, posterior tibialis, and/or plantar fascia may become slack and/or weak through injury, age, sedentary lifestyle, wearing certain footwear, or the like.

Conventionally, to attempt to relieve leg and/or foot pain, the foot may be externally supported (e.g., walking boot, orthopedic brace, foot arch support, tape wrap, compression sleeve) or a user may be instructed to perform calf and/or toe strengthening exercises. Calf and/or toe strengthening exercises may strengthen certain parts of the leg and/or foot and foot support may provide external support, but both may not be directed to the source of the problem, thus becoming a temporary solution that does not solve the root of the problem. For example, if one or more of flexor hallucis brevis, flexor digitorum longus, posterior tibialis, and/or plantar fascia is the cause of the pain, calf and/or toe strengthening exercises may strengthen the calf and/or toes and a foot support may provide external support, but both may not solve the cause of the problem (e.g., slack and/or weak flexor hallucis brevis, flexor digitorum longus, posterior tibialis, and/or plantar fascia).

The devices, systems, and methods disclosed herein may provide a foot exercise device. In some embodiments, the foot exercise device may allow the forefoot of the foot to move while other portions of the foot (e.g., heel, etc.) remain stationary. The foot exercise device may allow the forefoot to move towards the heel to shorten the distance between the forefoot and the heel while the arch height increases. The foot exercise device may include a base structure and a forefoot structure. The forefoot structure may be moved by the forefoot of a user while the base structure remains stationary. The forefoot may move the forefoot structure without use of the toes (e.g., without the toes touching the forefoot structure). The foot exercise device may cause certain parts of the foot and/or leg (e.g., one or more of the flexor hallucis brevis, flexor digitorum longus, posterior tibialis, plantar fascia, and/or the like) to be strengthened to reduce pain. The foot exercise device may further include a heel structure (e.g., a substantially vertical surface to contact the rear portion of the heel, a frictional horizontal surface to contact the bottom of the heel) to provide a point of contact to prevent the foot from moving during the moving of the forefoot structure by the forefoot of the user. The foot exercise device may include a stabilizing structure (e.g., vertical structure) that can be placed against a vertical surface (e.g., furniture, wall, etc.) to prevent the base structure from moving. In some embodiments, responsive to movement of the forefoot of the user, the forefoot structure may perform a pivoting movement relative to the base structure. In some embodiments, responsive to movement of the forefoot of the user, the forefoot structure may perform a translation movement relative to the base structure.

In some embodiments, the foot exercise device may allow the heel of the foot (e.g., disposed on a heel structure) to move while one or more other portions of the foot (e.g., forefoot, disposed on a base structure) remain stationary. The foot exercise device may allow the heel to move towards the forefoot to shorten the distance between the forefoot and the heel while the arch height increases. The heel structure may be moved by the heel by the user while the base structure remains stationary. The foot exercise device may not contact the toes (e.g., the forefoot structure may elevate the forefoot so that the toes do not contact the base structure). In some embodiments, responsive to movement of the heel of the user, the heel structure may perform a pivoting movement relative to the base structure. In some embodiments, responsive to movement of the heel of the user, the heel structure may perform a translation movement relative to the base structure.

The systems, devices, and methods disclosed herein have advantages over conventional solutions. The foot exercise device may strengthen one or more specific parts (e.g., one or more of the flexor hallucis brevis, flexor digitorum longus, posterior tibialis, and/or plantar fascia) of the foot and/or leg to alleviate and/or prevent pain. The foot exercise device may treat the cause of the pain instead of treating other portions of the foot and/or leg. The foot exercise device may be configured to be used to strengthen both feed of a user.

FIG. 1 illustrates a top view of a foot exercise device 100, according to certain embodiments. The foot exercise device may include one or more of a base structure 110 (e.g., base plate), one or more forefoot structures 120, a heel structure 130, or one or more stabilizing structures 140.

The foot exercise device 100 may include a base structure 110. The base structure 110 may be configured to remain stationary (e.g., during use of the foot exercise device 100). The base structure 110 may be a base plate. Other components of the foot exercise device 100 may be coupled to (e.g., connected to, disposed on, adhered to, fastened to, removably attached to, etc.) the base structure 110. The base structure 110 may have one or more openings (e.g., holes, channels, threaded openings, through holes, etc.) for coupling to components of the foot exercise device 100 (e.g., for receiving fasteners, etc.). In some embodiments, the base structure 110 is the primary point of contact of the foot of the user. The base structure may include one or more frictional components 310 (e.g., see FIGS. 3A-B). One or more frictional components 310 may be disposed on (or integral to) a bottom surface of the base structure 110 to prevent movement between the base structure 110 and the floor. One or more frictional components 310 may be disposed on (or integral to) a top surface of the base structure 110 to prevent movement between one or more portions of the foot and the base structure. One or more frictional components 310 may be disposed on (or integral to) other components (e.g., forefoot structure 120, heel structure 130) of the foot exercise device 100 to prevent movement between one or more portions of the foot and the components.

The foot exercise device 100 may include one or more forefoot structures 120. The forefoot structures 120 may be paddles and may be mounted on either side a top surface of the base structure 110. The forefoot structures 120 may be a paisley design (e.g., see FIGS. 3A-B), where the wide end of a forefoot structure 120 fits under the widest area of the ball of the foot. The wide end may be located towards the center of the base structure 110 with the narrow end hosting the swivel (e.g., fastener 122). The forefoot structure 120 (e.g., paddle for forefoot) may be configured to pivot around a hole without engaging the toes of the foot. The forefoot structure 120 (e.g., and head of the fastener 122) may be recessed slightly to accommodate the pinky toe. The upper surface of the fastener 122 may be substantially coplanar with the upper surface of the forefoot structure 120. The upper surface of the fastener 122 may be in a plane that is lower than the plane of the upper surface of the forefoot structure 120 (e.g., the upper surface of the fastener 122 is recessed compared to the upper surface of the forefoot structure 120) The forefoot structure 120 may widen to fit the pad of the foot (e.g., forefoot) proximate the inside edge of the foot.

The foot exercise device 100 may include a heel structure 130 coupled to the base structure 110. The heel structure 130 may include a frictional horizontal surface configured to contact a bottom surface of a heel of the user. The heel structure 130 may further include a substantially vertical surface configured to contact a rear surface of the heel. The heel structure 130 may be a heel cup (e.g., extends vertically to provide a point of contact with the back of the heel of the foot). The heel structure 130 may be mounted on the center of the base structure 110 in a manner that allows the heel structure 130 to be placed in locations closer or further from the forefoot structures 120 (e.g., the heel structure may be removably attached to the base structure via one or more fasteners 132 via openings in the base structure 110 that are closer and further from the forefoot structure 120 to accommodate different sizes of feet).

In some embodiments, the foot exercise device 100 includes a stabilizing structure 140 coupled to the base structure 110. The stabilizing structure 140 is configured to be placed against a vertical surface to prevent the base structure from moving. The stabilizing structure 140 may extend substantially vertically to contact an object (e.g., couch, wall, chair, block, brick, step, etc.) to provide stability to (e.g., prevent movement of) the foot exercise device 100.

In some embodiments, one or more resistance components (e.g., resistance band) may be coupled to the forefoot structure 120. For example, a resistance band may be attached to the front of the forefoot structure 120 on the wide end. The other end of the resistance band may be attached to the base structure 110 (e.g., towards the front away from the heel structure 130). Each forefoot structure 120 may have its own resistance component. The resistance components may be interchanged to provide more or less resistance.

The foot exercise device 100 may be configured to help users activate and strengthen one or more particular parts of the foot and/or leg. In some embodiments, the foot exercise device 100 is configured to help users activate and strengthen one or more of their flexor hallucis brevis, flexor digitorum longus, posterior tibialis, and/or plantar fascia. The flexor hallucis brevis, flexor digitorum longus, posterior tibialis, and/or plantar fascia may include key tendons and muscles that control transfer of weight in the foot and may be a major cause of leg and/or foot pan when the flexor hallucis brevis, flexor digitorum longus, posterior tibialis, and/or plantar fascia or associated fascia become inflamed or damaged. Strengthening and stretching muscles and tendons associated with the flexor hallucis brevis, flexor digitorum longus, posterior tibialis, and/or plantar fascia (e.g., toes, calves), but not focusing directly on activating and strengthening the flexor hallucis brevis, flexor digitorum longus, posterior tibialis, and/or plantar fascia may not focus on the cause of pain. Conventionally, users may rarely have the muscle memory or dexterity to begin the process of activating and strengthening of the flexor hallucis brevis, flexor digitorum longus, posterior tibialis, and/or plantar fascia and may struggle to visualize the needed motions.

The foot exercise device 100 may be used to directly activate and strengthen one or more of the flexor hallucis brevis, flexor digitorum longus, posterior tibialis, and/or plantar fascia. The foot exercise device 100 may create a comprehensible task for users to accomplish which may enable the usage of hitherto unused muscles. The user may gain the ability to contract the arch of the foot laterally and increase the height of the foot vertically by using the foot exercise device 100.

While sitting, a user may place their heel in the heel structure 130 (e.g., back cup) and the ball of their foot on the top of the forefoot structure 120 (e.g., paddle). The forefoot structure 120 with a pivot (e.g., fastener 122) on the right side of the base structure 110 may be used by the right foot. The forefoot structure 120 with a pivot (e.g., fastener 122) on the left side of the base structure 110 may be used by the left foot. With the forefoot structure 120 under the pad of the foot at a perpendicular angle, the user may attempt to move (e.g., wiggle) the forefoot structure back and forth with small precise movements. These movements may appear impossible at first but with repeated usage of the foot exercise device 100, the foot exercise device 100 may allow the user to gain control of flexing of the flexor hallucis brevis, flexor digitorum longus, posterior tibialis, and/or plantar fascia. The base structure 110 may have markings to indicate proper starting positions of the foot and goals for moving the forefoot structure 120. Grips (e.g., frictional components 310, see FIGS. 3A-B) may be attached to the bottom of the base structure 110 to prevent the foot exercise device 100 (e.g., the base structure 110) from sliding.

The forefoot structure 120 may be a pivoting paddle and may fit under the pad of the foot and may not accommodate room for the toes which isolates the flexor hallucis brevis, flexor digitorum longus, posterior tibialis, and/or plantar fascia tendons. The foot exercise device 100 may have adjustable sizing through either moving (e.g., fastening, coupling) the heel structure 130 (e.g., heel cup) or the forefoot structure 120 (e.g., paddles) into different sets of holes in the base structure 110 to accommodate different foot sizes and the left and right foot in one foot exercise device 100. The foot exercise device 100 may be used for a therapy that focuses on an isolation and then activation of the flexor hallucis brevis, flexor digitorum longus, posterior tibialis, and/or plantar fascia.

While sitting, a user may learn to move the arch of their foot using the foot exercise device 100. The user may learn to move the arch of their foot while standing from usage of the foot exercise device 100. The user may learn to activate the arch of the foot while walking, jumping, running, etc. The user may use the foot exercise device 100 periodically to reactivate the arch of the foot.

Physical therapists and other medical practitioners have struggled explaining to users how to flex and activate key areas of the foot which requires significant trial and error. Patients also struggle to execute these movements because they have yet to develop the necessary dexterity to properly execute the movements. The foot exercise device 100 may include a heel structure 130 (e.g., movable heel cup) to accommodate all foot sizes in men and women and one or more forefoot structures 120 (e.g., two paddles) that articulate in two dimensions which sit under the ball of the foot. Each forefoot structure 120 (e.g., paddle) may be mounted on opposite sides of an upper surface of a base structure 110 (e.g., mounting board) allowing one foot exercise device 100 to be used by both the right and the left foot.

Some conventional devices focus on relieving inflammation of the arch or engaging the toes of the foot in the attempt to overcome pain in the heel or the arch (e.g., rolling a device under an arch while applying pressure to cause the inflamed tendons to loosen and stretch. Some conventional devices ignore the foot entirely by immobilizing the foot to shift the burden to the calf muscles. Some conventional devices engage the toes of the foot with a grabbing motion. Conventional devices do not work to activate, strengthen, and involve the tendons and muscles of the arch of the foot. One of the most effective ways to reduce pain in the foot is to reduce pain in the foot is to have the user develop the ability to raise the arch of the foot and squeeze the lateral distance by bringing the ball of the foot towards the heel in small movements. By executing the small movements with the foot exercise device 100, users may build muscle ability, dexterity, and ability in key muscles and tendons of the foot's arch. Conventional devices fail to exercise and strengthen the arch of the foot. Conventional devices may activate other parts of the foot or foot related fascia (tendons and muscles), but do not aim to or affect the arch of the foot (e.g., do not affect one or more of flexor hallucis brevis, flexor digitorum longus, posterior tibialis, and/or plantar fascia). The foot exercise device 100 specifically targets the foot's ability to raise and laterally shorten the arch of the foot. Since users can slowly improve their ability to raise and contract their arches by using the foot exercise device 100, medical practitioners may use the foot exercise device 100 as a teaching tool to help users visualize and properly engage the movements that may not be possible at the outset of treatments. Because the foot exercise device 100 is simple to use, patients may use the foot exercise device 100 without medical supervision.

The one or more forefoot structures 120 (e.g., paddles) may be configured to fit under the ball of the foot that the user must then slide towards the heel. The forefoot structure 120 (e.g., paddle) may be configured to prevent the toes of the foot from engaging one or more of the forefoot structure 120, the base structure 110, or the foot exercise device 100. The pivot (e.g., fastener 122) on the outside of the forefoot structure 120 may keep the necessary micro-movements in proper alignment, thus forcing the targeted muscles in the arch of the foot to engage.

The foot exercise device 100 may target one or more parts of the foot and/or leg that conventional devices are unable to target. The foot exercise device 100 may provide foot pain prevention and techniques in a manner that users can quickly and accurately implement. The foot exercise device 100 may work for both feet, left and right, and for individuals of all foot sizes.

The foot exercise device 100 may provide an enabling platform for individuals to laterally contract and raise the height of their foot which is one of the most effective movements for pain reduction and prevention.

The foot exercise device 100 may strengthen (e.g., reduce pain of, prevent pain of) one or more of the flexor hallucis brevis, flexor digitorum longus, posterior tibialis, and/or plantar fascia. The foot exercise device 100 may also help reduce pain of the heel, the arch, the knee, or the like. Many people suffer from flexor hallucis brevis pain, flexor digitorum longus pain, posterior tibialis pain, and/or plantar fascia pain. The flexor hallucis brevis, flexor digitorum longus, posterior tibialis, and/or plantar fascia may become slack and weak. The foot exercise device 100 may be used to wake up one or more of the flexor hallucis brevis, flexor digitorum longus, posterior tibialis, and/or plantar fascia and rebuild the muscle memory to get the flexor hallucis brevis, flexor digitorum longus, posterior tibialis, and/or plantar fascia functioning well. The flexor hallucis brevis, flexor digitorum longus, posterior tibialis, and/or plantar fascia may become slack and weak through injury, age, sedentary lifestyle, footwear worn, or the like. Footwear may compensate for the strength used by one or more of the flexor hallucis brevis, flexor digitorum longus, posterior tibialis, and/or plantar fascia.

Conventional therapy focuses on calf muscles and/or toe dexterity. The muscles that control the transfer of weight in the inside of the foot are not strengthened by calf exercises and those types of stretching, nor are they activated when the toes are extended. The muscles that contract between toe exercises (e.g., putting a towel under the feet and scrunching toes towards the heel to try to move the towel) are different than the flexor hallucis brevis, flexor digitorum longus, posterior tibialis, and plantar fascia. Conventional therapy that focuses on calf muscles and/or toe dexterity may strengthen supporting features while not focusing on the issue at hand which is the slack found in one or more of the flexor hallucis brevis, flexor digitorum longus, posterior tibialis, and/or plantar fascia. Working on the calf and/or toes is a temporary fix and is not focusing on the core issue. Some muscles in the calf are responsible for flexing the foot and others, such as flexor digitorum longus and posterior tibialis, are used to transfer weight and hold the foot's proper structure. The foot exercise device 100 may be used to strengthen the flexor hallucis brevis, flexor digitorum longus, posterior tibialis, and/or plantar fascia (e.g., without resistance, not a weightlifting style).

To use the foot exercise device 100, the ball of the foot is moved (e.g., without moving the toes). The ball of the foot may undergo lateral motion by bringing the ball of the foot together towards the heel to raise the arch in the foot.

In some embodiments, the forefoot structure 120 is configured to be rotated (e.g., via a pivot, fastener 122) by the forefoot of the user towards and away from the heel structure 130. In some embodiments, the forefoot structure 120 is configured to be translated (e.g., via one or more slots) by the forefoot of the user towards and way from the heel structure 130. In some embodiments, the heel structure 130 is configured to be translated (e.g., via one or more slots) by the heel of the user towards and way from the forefoot of the user.

The forefoot structure 120 (or end of the base structure in FIG. 2D) may be one or more different shapes to avoid contacting the toes (e.g., to avoid the pinky toe muscle from grabbing the forefoot structure 120), such as a paisley shape, a teardrop shape, a rectangular shape, a triangular shape, or the like.

The foot exercise device 100 may be used over time to isolate the forefoot and activate by doing a motion by one or more of the flexor hallucis brevis, flexor digitorum longus, posterior tibialis, and/or plantar fascia. The flexor hallucis brevis, flexor digitorum longus, posterior tibialis, and/or plantar fascia may be strengthened by doing the motion over a period of time. Reactivation of a muscle (e.g., one or more of the flexor hallucis brevis, flexor digitorum longus, posterior tibialis, and/or plantar fascia) may include allowing the muscle to get strong and return to a non-slack form, flexing the muscle, and/or learning to focus on the muscle.

The therapy to strengthen one or more of the flexor hallucis brevis, flexor digitorum longus, posterior tibialis, and/or plantar fascia may be difficult to explain and conceptualize, so the foot exercise device 100 helps a user learn how to move and activate one or more of the flexor hallucis brevis, flexor digitorum longus, posterior tibialis, and/or plantar fascia. The foot exercise device 100 may teach a user the mental exercise of proper motion and execution of one or more of the flexor hallucis brevis, flexor digitorum longus, posterior tibialis, and/or plantar fascia.

In some embodiments, one or more resistance bands are used to provide more resistance to the forefoot structure 120 (or the heel structure 130). In some embodiments, the fastener 122 (e.g., pivot) is tightened to provide resistance. In some embodiments, a coil is added to the fastener 122 to provide resistance. A user may start with less resistance and may work up to greater resistance over time as the foot gets stronger.

In some embodiments, there may be different sizes of foot exercise devices 100 for different sized people (e.g., child size and adult size). In some embodiments, there are different shaped components (e.g., base structure 110, forefoot structure 120, heel structure 130, etc.) for different shaped feet. In some embodiments, the lateral distance from heel structure 130 to forefoot structure 120 may be adjustable for different sized feet.

The foot exercise device 100 may be used by users that are experiencing leg and/or foot pain (e.g., to strengthen the flexor hallucis brevis, flexor digitorum longus, posterior tibialis, and/or plantar fascia to reduce leg and/or foot pain) and by people that are not experiencing leg and/or foot pain (e.g., to strengthen the flexor hallucis brevis, flexor digitorum longus, posterior tibialis, and/or plantar fascia to prevent leg and/or foot pain and/or avoid injury).

In some embodiments, the foot exercise device 100 may be used for minutes each day (e.g., about 5-10 minutes) over about 2-3 weeks to strengthen the flexor hallucis brevis, flexor digitorum longus, posterior tibialis, and/or plantar fascia. The foot exercise device 100 may be used for pain reduction. By performing the exercise (e.g., moving forefoot and/or heel relative to each other), the pain in the leg and/or foot caused by the flexor hallucis brevis, flexor digitorum longus, posterior tibialis, and/or plantar fascia may be reduced.

The foot exercise device 100 may provide 1-3 points of contacts on the foot (e.g., contacts the foot in 1-3 locations on the foot). The foot exercise device 100 may provide a point of contact on the forefoot (e.g., the foot exercise device 100 contacts the forefoot to allow the forefoot and/or heel to move relative to each other). The foot exercise device 100 may provide a point of contact on the bottom of the heel (e.g., the foot exercise device 100 contacts the bottom of the heel to allow the forefoot and/or heel to move relative to each other). The foot exercise device 100 may provide a point of contact at the back of the heel (e.g., the foot exercise device 100 contacts the back of the heel to prevent the interior parts of the heel from moving while the skin at the bottom of the heel remaining stationary). In some embodiments, the foot exercise device 100 provides a point of contact only at the forefoot. In some embodiments, the foot exercise device 100 provides a point of contact only at the bottom of the heel. In some embodiments, the foot exercise device 100 provides a point of contact only at the forefoot and the bottom of the heel. In some embodiments, the foot exercise device 100 provides points of contact only at the forefoot, at the bottom of the heel, and the back of the heel.

The base structure 110 may be different shapes (e.g., rectangle, shaped based on the components to be coupled to the base structure 110). There may be a component to hold unused parts (e.g., clip or magnet to hold other base structure for the other foot that could be changed out). The components may be made of plastic, metal, or other materials.

The bottom of the heel and the bottom of the forefoot may be substantially coplanar when disposed on the foot exercise device 100 (e.g., the portion of the forefoot structure 120 where the forefoot engages and the portion of the heel structure 130 where the bottom of the heel engages may be substantially coplanar).

The fasteners 122 may be one or more of a post screw and a post screw base, a bolt and nut, or the like. The head of the fasteners 122 could be under the base structure or in a counterbore to not protrude from the forefoot structure 120 and/or heel structure 130 (e.g., to not interfere with foot placement, to not cause injury to a user). The fasteners 122 may include a quick-release (e.g., a clasp, a snap, or the like).

There may be one or more markings on the base structure 110 to help a user track their progress. There may be one or more markings on the foot exercise device 100 (e.g., on the base structure 110, forefoot structure 120, heel structure 130, or the like) showing where to put the foot and how to use the device.

In some embodiments, the forefoot structure 120 is prevented from moving too far forward to prevent the toes from contacting the forefoot structure 120. The motion may be restricted. There may be a pin or other component on the fastener 122 between the forefoot structure 120 and the base structure 110 or a component could extend from the forefoot structure 120 to prevent some motion.

FIGS. 2A-D illustrate cross-sectional side views of foot exercise devices 100, according to certain embodiments. Features of FIGS. 2A-D that have the same or similar reference numbers as those in FIG. 1 may have same or similar structure and/or functionality as those in FIG. 1.

Referring to FIGS. 2A-D, the foot exercise device 100 may include a forefoot structure coupled to the base structure 110. The forefoot structure 120 is configured to be moved by a forefoot of a user while the base structure 110 remains stationary. The forefoot structure 120 is configured to be moved by the forefoot towards heel of the user to shorten a distance between the forefoot and the heel and increase height of arch of the user. The forefoot structure 120 is configured to be moved by the forefoot without toes of the user engaging with the foot exercise device 100. The forefoot structure 120 is configured to be moved by the forefoot to strengthen one or more of flexor hallucis brevis, flexor digitorum longus, posterior tibialis, and/or plantar fascia of the user.

In some embodiments, an upper surface of the forefoot structure 120 includes a first distal area and a second distal area. The first distal area that has a wider surface area configured to interface with a wider distal lower surface area of the forefoot and the second distal area that has a narrower surface area configured to interface with a narrower distal lower surface area of the forefoot.

Figure 2A:
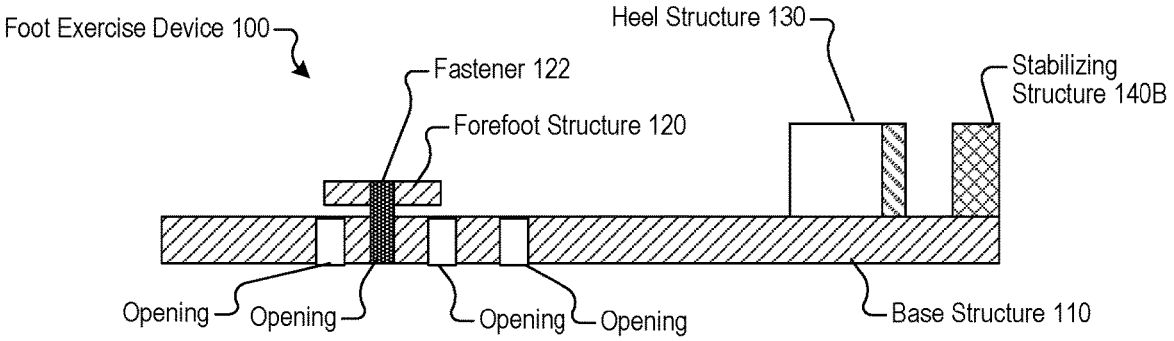
FIGS. 2A-D illustrate cross-sectional side views of foot exercise devices, according to certain embodiments.

Referring to FIG. 2A, a foot exercise device 100 may include a forefoot structure 120 (e.g., paddle) that is connected to the base structure 110 via a fastener 122. The forefoot structure 120 may pivot (e.g., rotate) relative to the base structure 110 via the fastener 122. The base structure 110 may include multiple openings and the forefoot structure 120 may be coupled to the base structure 110 via the fastener 122 interconnecting to the base structure 110 via one of the openings. The forefoot structure 120 may be removed from one opening and connected via the fastener 122 to a different opening to accommodate different foot sizes. The foot exercise device 100 may have a stabilizing structure 140B proximate the heel structure 130 to stabilize the foot exercise device 100 (e.g., prevent movement of the base structure 110) during movement of the forefoot structure 120 towards the heel structure 130. In some embodiments, the stabilizing structure 140B and the heel structure 130 are integrated into one structure (e.g., the heel structure 130 is to be placed against an object, such as a couch, wall, stair, etc.).

In some embodiments, the foot exercise device 100 includes a forefoot structure 120A and a forefoot structure 120B. The forefoot structure 120A is configured to interface with a right foot and the forefoot structure 120B is configured to interface with a left foot. A fastener 122A coupled to the forefoot structure 120A and the base structure 110. The forefoot structure 120A is configured to pivot relative to the base structure 120 via the fastener 122A. A fastener 122B is coupled to the forefoot structure 120B and the base structure 110. The forefoot structure 120B is configured to pivot relative to the base structure 110 via the fastener 122B.

Figure 2B:
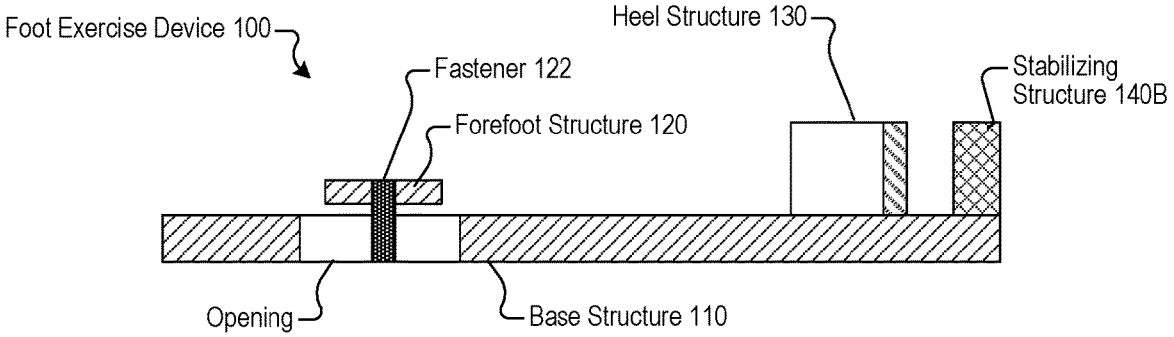

Referring to FIG. 2B, a foot exercise device 100 may include one or more fasteners 122. The base structure 110 may form one or more openings (e.g., slots). The forefoot structure 120 is connected to the base structure 110 via the one or more fasteners 122. The forefoot structure 120 is configured to move translationally relative to the base structure 110 via the one or more fasteners 122 interfacing with the one or more openings. For example, each of the one or more fasteners 122 may couple with a corresponding slot. The forefoot structure 120 may undergo translational movement relative to the base structure 110 via each of the one or more fasteners 122 moving within the corresponding slot (e.g., forefoot structure 120 may move towards and/or away from the heel structure). The stabilizing structure 140B of FIG. 2B may be similar to the stabilizing structure 140B of FIG. 2A.

Figure 2C:
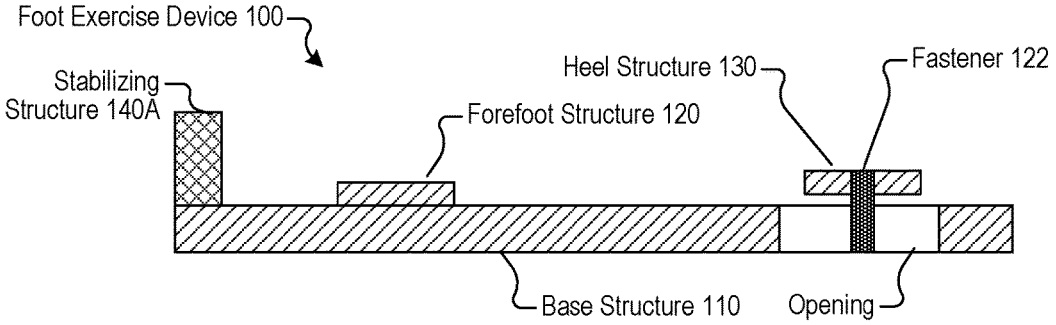
Figure 2D:
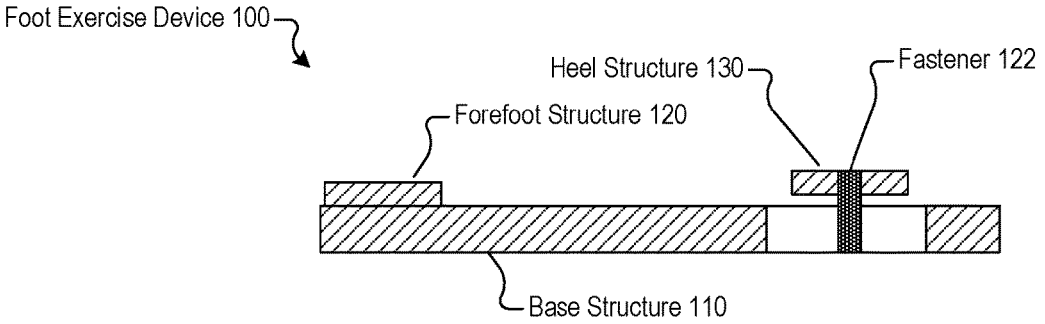

Referring to FIGS. 2C-D, in some embodiments, the foot exercise device 100 includes a heel structure 130 coupled to the base structure 110. The heel structure 130 is configured to be moved by a heel of a user while the base structure 110 remains stationary. The heel structure 130 is configured to be moved by the heel towards forefoot of the user to shorten a distance between the forefoot and the heel and increase height of arch of the user. The heel structure 130 is configured to be moved by the heel without toes of the user engaging with the foot exercise device 100. The heel structure 130 is configured to be moved by the heel to strengthen one or more of flexor hallucis brevis, flexor digitorum longus, posterior tibialis, and/or plantar fascia of the user.

The foot exercise device 100 may include one or more fasteners 122. In some embodiments, the base structure 110 forms one or more openings and the heel structure 130 is configured to pivot or move translationally relative to the base structure 110 via the one or more fasteners 122 interfacing with the one or more openings.

The foot exercise device 100 may include a forefoot structure 120 coupled to the base structure 110. In some embodiments, the forefoot structure 120 includes a frictional horizontal surface configured to contact a bottom surface of a forefoot of the user. An upper surface of the forefoot structure 120 may include a first distal area that has a wider surface area configured to interface with a wider distal lower surface area of the forefoot and a second distal area that has a narrower surface area configured to interface with a narrower distal lower surface area of the forefoot. The heel structure 130 includes a frictional horizontal surface configured to contact a bottom surface of the heel. The heel structure 130 may include a substantially vertical surface configured to contact a rear surface of the heel.

Referring to FIG. 2C, a foot exercise device 100 may include a heel structure 130 that is connected to the base structure 110 via one or more fasteners 122. Each of the one or more fasteners 122 may couple with a corresponding slot. The heel structure 130 may undergo translational movement relative to the base structure 110 via each of the one or more fasteners 122 moving with the corresponding slot (e.g., heel structure 130 may move towards and/or away from the forefoot structure). The foot exercise device 100 may have a stabilizing structure 140B proximate the heel structure 130 to stabilize the foot exercise device 100 (e.g., prevent movement of the base structure 110) during movement of the heel structure 130 towards the forefoot structure 120. The foot exercise device 100 may have a stabilizing structure 140A proximate the forefoot structure 120 to stabilize the foot exercise device 100 (e.g., prevent movement of the base structure 110) during movement of the heel structure 130 towards the forefoot structure 120. The forefoot structure 120 may elevate the forefoot so that the toes do not engage with the base structure 110. The heel structure 130 may include a horizontal portion to engage with the bottom of the heel. The heel structure 130 may include a vertical portion to engage with the back of the heel. The heel structure 130 may have a frictional surface (e.g., on at least a portion of the vertical portion) to prevent movement of the heel relative to the heel structure 130.

Referring to FIG. 2D, a foot exercise device 100 may include a heel structure 130, one or more fasteners 122, one or more corresponding slots, and forefoot structure 120 similar to those of FIG. 2C. The forefoot structure 120 may be disposed at the end of the base structure 110 so that the toes hang off of the foot exercise device 100 and do not engage with the foot exercise device 100 (e.g., so that the toes are isolated). In some embodiments, the foot exercise device 100 of FIG. 2D does not have a forefoot structure 120.

In some embodiments, a foot exercise device 100 includes a forefoot structure 120 (e.g., forefoot structure 120 of FIG. 2A or 2B) and a heel structure 130 (e.g., heel structure 130 of FIG. 2C or 2D) that both move relative to the base structure 110 (e.g., forefoot structure 120 can be moved towards the heel structure 130 and/or the heel structure 130 can be moved towards the forefoot structure 120).

Figure 3A:
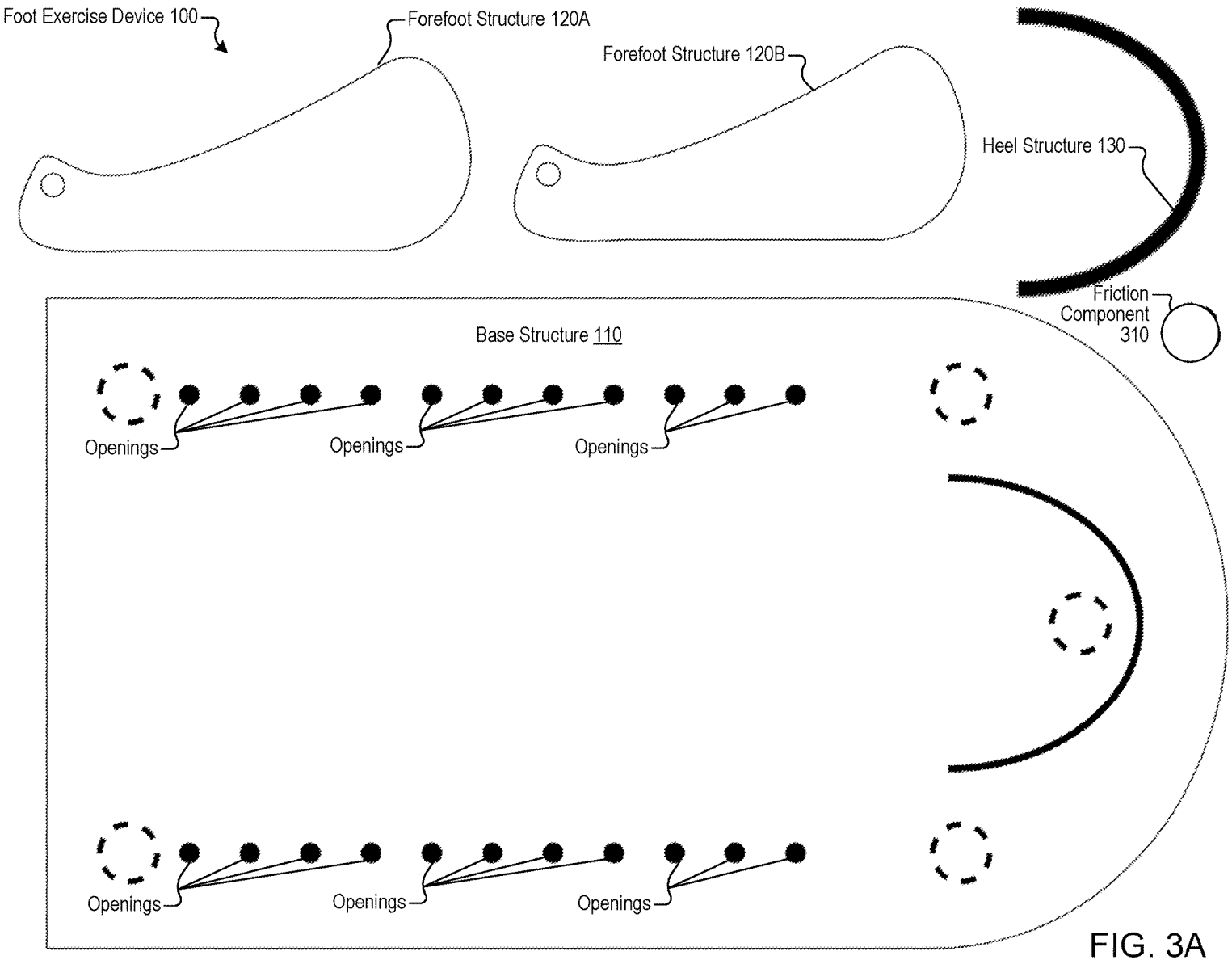
FIGS. 3A-B illustrate a top view of a foot exercise device, according to certain embodiments.
Figure 3B:
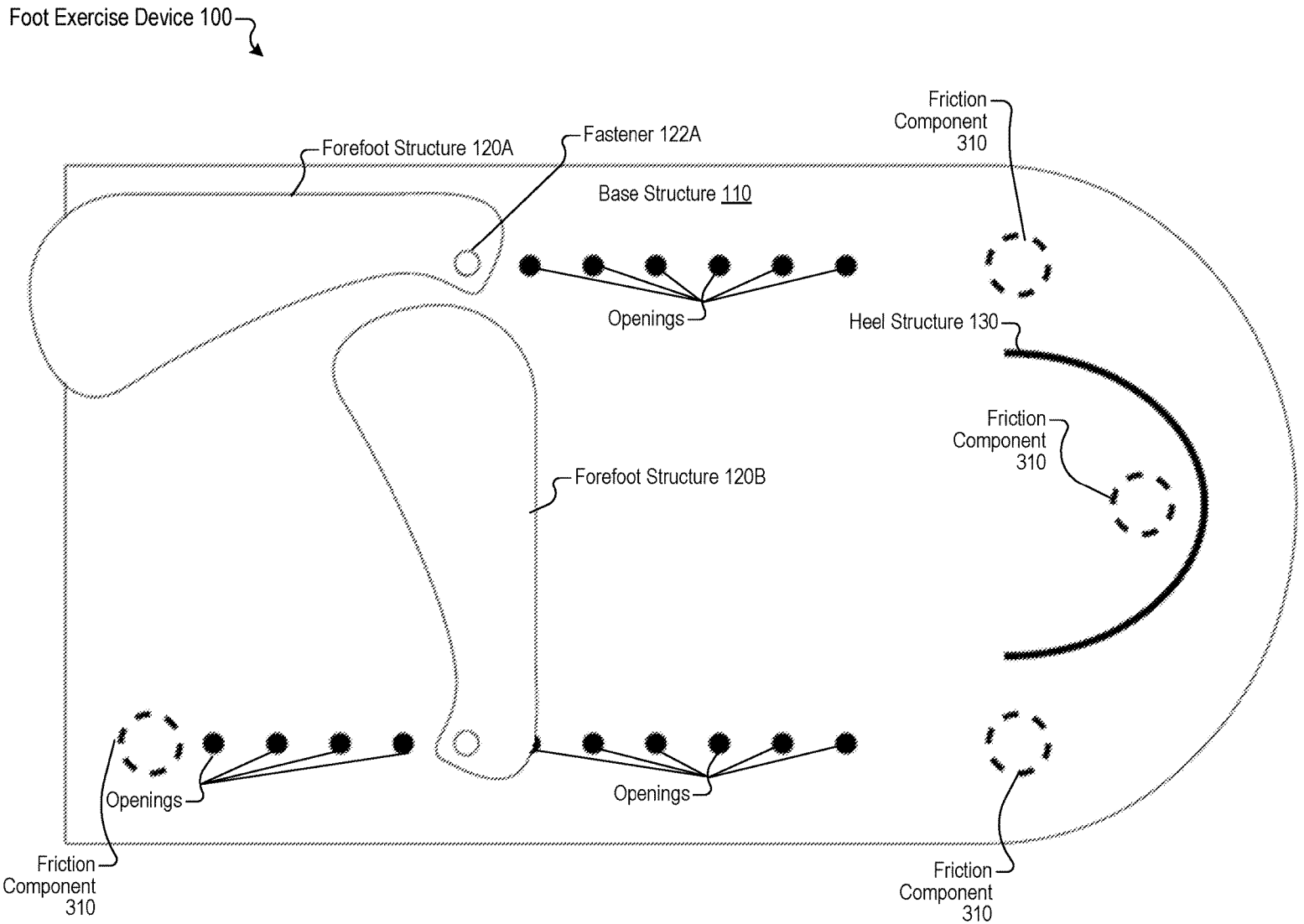

FIGS. 3A-B illustrate a top view of a foot exercise device 100, according to certain embodiments. A foot exercise device 100 may include a base structure 110, forefoot structures 120A-B, a heel structure 130, and one or more friction components 310. The friction component 310 may be a friction pad. The friction components 310 may be disposed at one or more locations on a bottom surface and/or upper surface of the base structure 100. The base structure 110 may include one or more openings. A forefoot structure 120 may be coupled to an opening of the base structure 110 via a fastener 122 based on the size of the foot. The forefoot structures 120 and/or heel structure 130 may be located on the base structure 110 so that the heel of the user engages with the heel structure 130 and the forefoot engages with the forefoot structure 120 (e.g., without the forefoot structure 120 or any other portion of the foot exercise device 100 engaging with the toes of the user).

Referring to FIG. 3B, the forefoot structures 120A-B may both be coupled to the base structure 110 via corresponding fasteners 122A-B. The right forefoot structure 120A may be rotated to be substantially parallel with the foot and the left forefoot structure 120B may be rotated to be substantially perpendicular with the forefoot structure 120A so that the left forefoot structure 120B can engage with the left forefoot of a user without interface of the right forefoot structure 120A (e.g., without the foot engaging with the right forefoot structure 120A). For use with the right forefoot, the left forefoot structure 120B may be rotated to be substantially parallel with the foot and the right forefoot structure 120A may be rotated to be substantially perpendicular with the left forefoot structure 120B so that the right forefoot structure 120A can engage with the right forefoot of the user without interference of the left forefoot structure 120B (e.g., without the foot engaging with the left forefoot structure 120B). The foot exercise device 100 can be used for both feet without removing components.

Figure 4A:
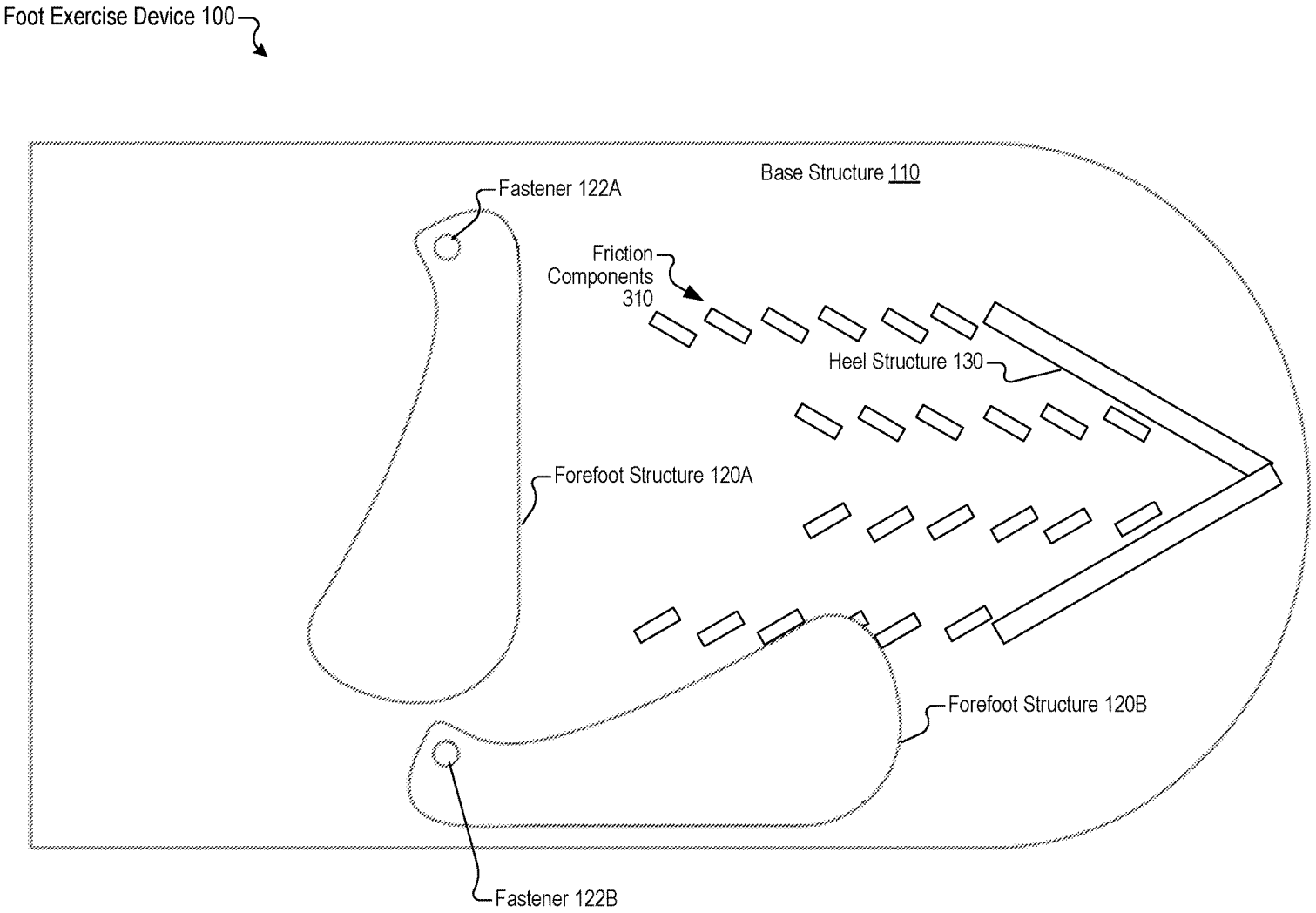
FIGS. 4A-C illustrate a foot exercise device, according to certain embodiments.
Figure 4B:
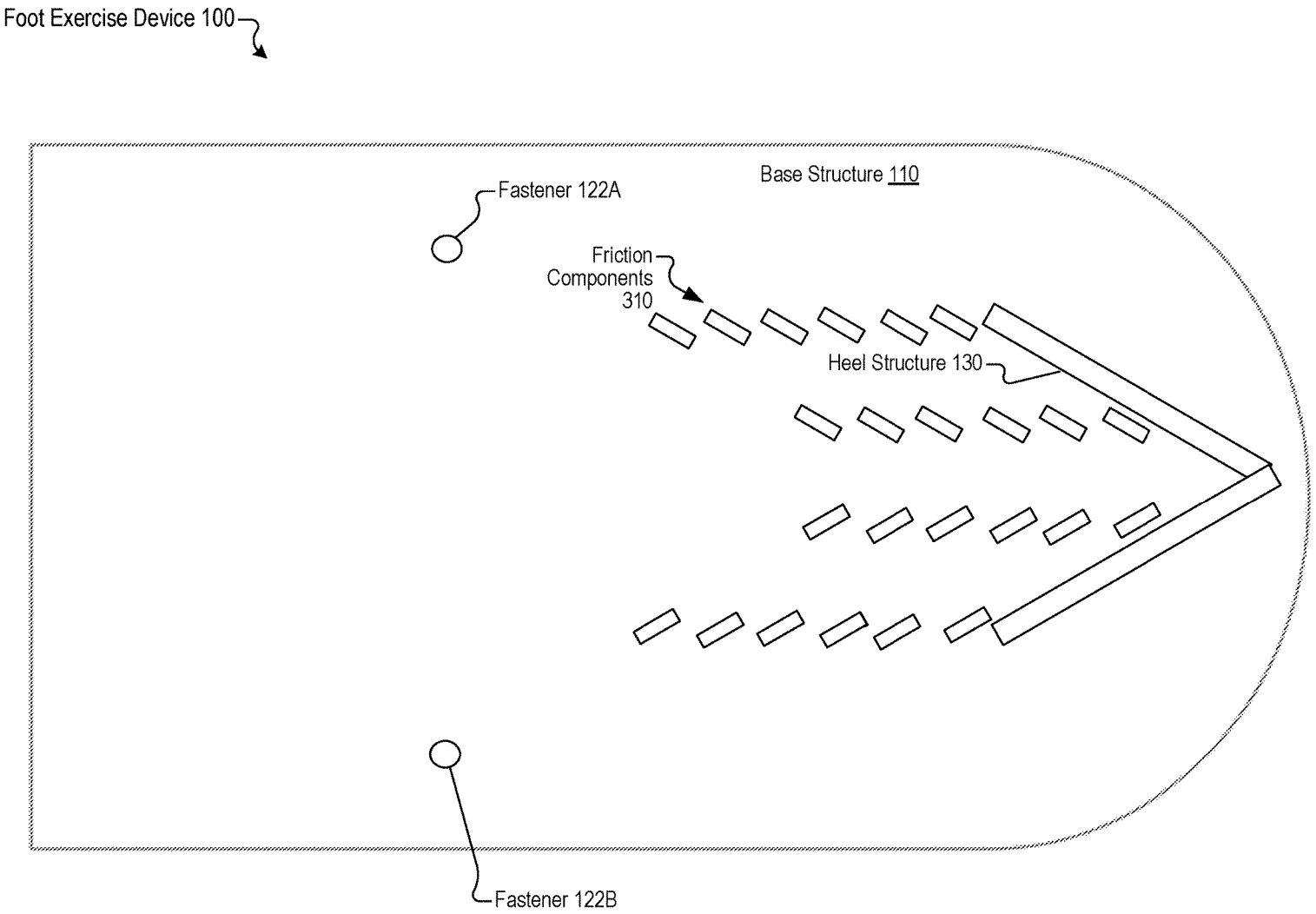
Figure 4C:
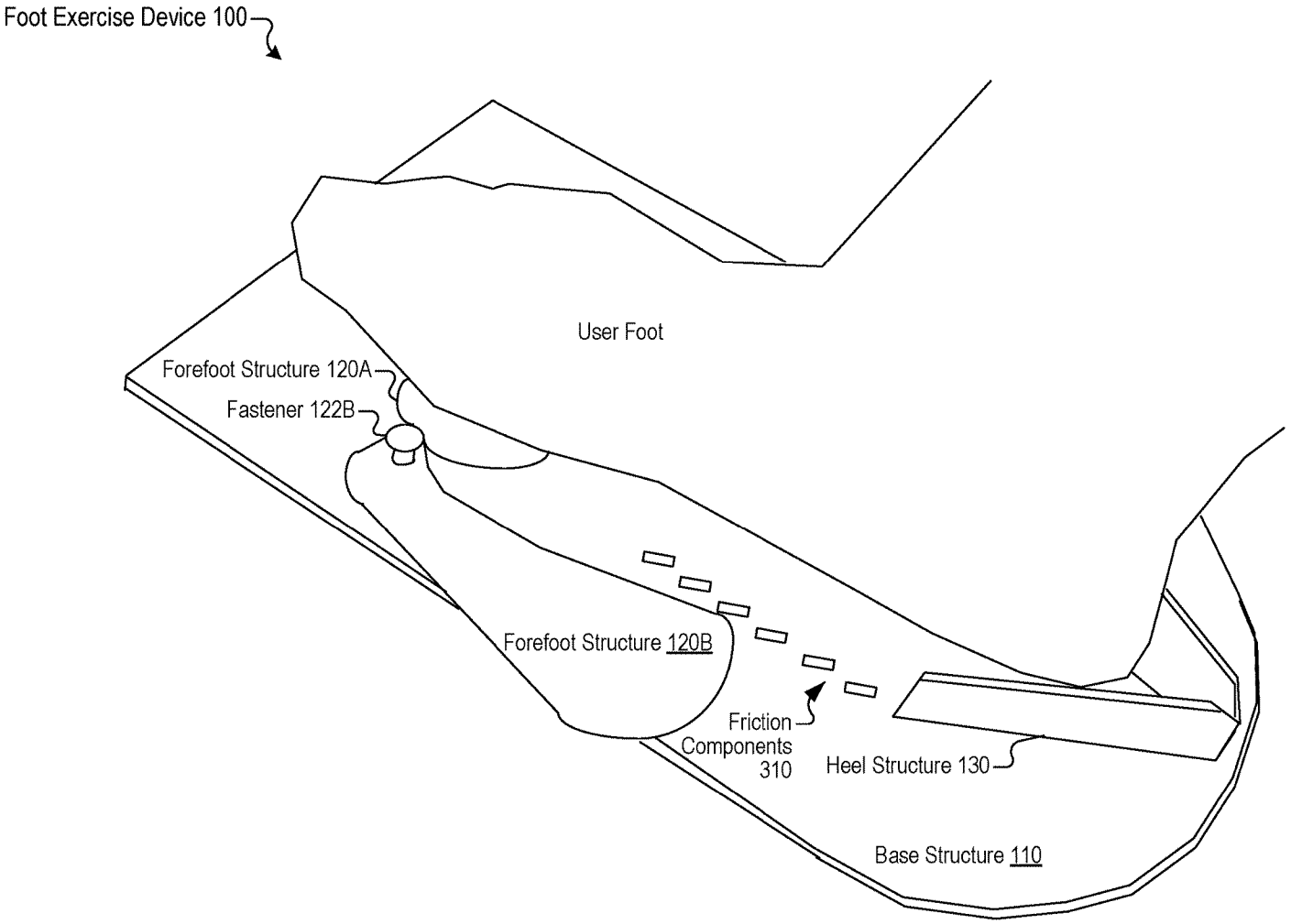

FIGS. 4A-C illustrate a foot exercise device 100, according to certain embodiments.

FIG. 4A is a top view of the foot exercise device 100. Forefoot structure 120B can be moved towards the heel structure 130 so that the user may use the forefoot structure 120A.

FIG. 4B is a bottom view of the foot exercise device 100. One or more friction components 310 may be coupled to the bottom of the base structure 110 to prevent movement of the base structure 110 relative to the floor.

FIG. 4C is a perspective view of a foot exercise device 100. The right forefoot of a user may be disposed on the right forefoot structure 120A without the toes of the user contacting the right forefoot structure 120A. The left forefoot structure 120B may be rotated to not contact the foot. The user may move the forefoot structure 120A towards the heel structure 130 to strengthen one or more of the flexor hallucis brevis, flexor digitorum longus, posterior tibialis, and/or plantar fascia. The foot exercise device 100 may be used with a covering for the foot (e.g., using a sock) or without a covering for the foot (e.g., barefoot).

The preceding description sets forth numerous specific details such as examples of specific systems, components, methods, and so forth in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular implementations may vary from these exemplary details and still be contemplated to be within the scope of the present disclosure.

Reference throughout this specification to "one embodiment," "an embodiment," or "some embodiments" means that a particular feature, structure, or characteristic described in connection with the embodiment is included in at least one embodiment. Thus, the appearances of the phrase "in one embodiment," "in an embodiment," or "in some embodiments" in various places throughout this specification are not necessarily all referring to the same embodiment. In addition, the term "or" is intended to mean an inclusive "or" rather than an exclusive "or." When the term "about" or "approximately" is used herein, this is intended to mean that the nominal value presented is precise within ±10%.

Although the operations of the methods herein are shown and described in a particular order, the order of operations of each method may be altered so that certain operations may be performed in an inverse order so that certain operations may be performed, at least in part, concurrently with other operations. In another embodiment, instructions or sub-operations of distinct operations may be in an intermittent and/or alternating manner.

It is understood that the above description is intended to be illustrative, and not restrictive. Many other embodiments will be apparent to those of skill in the art upon reading and understanding the above description. The scope of the disclosure should, therefore, be determined with reference to the appended claims, along with the full scope of equivalents to which such claims are entitled.

What is claimed is:

1. A foot exercise device comprising:

a base structure having a substantially flat upper surface configured to remain stationary, wherein a heel cup is disposed on the substantially flat upper surface, wherein a first heel or a second heel of a user is configured to be disposed on the substantially flat upper surface of the base structure, and wherein the heel cup comprises a vertical surface configured to contact a rear surface of the first heel or the second heel;

a first paddle structure configured to interface with a first forefoot responsive to the first heel being disposed on the base structure, the first paddle structure being pivotally coupled to the base structure proximate a first edge of the base structure, wherein the first paddle structure is configured to be pivoted in a first plane by the first forefoot of the user while the base structure remains stationary in a second plane that is approximately parallel to the first plane and the first heel of the user remains stationary on the base structure;

a second paddle structure configured to interface with a second forefoot responsive to the second heel being disposed on the base structure, a first foot of the user comprising the first forefoot and the first heel, a second foot of the user comprising the second forefoot and the second heel;

a first fastener coupled to the first paddle structure and the base structure proximate the first edge of the base structure, wherein the first paddle structure is configured to pivot relative to the base structure via the first fastener; and a second fastener coupled to the second paddle structure and the base structure proximate a second edge of the base structure that is opposite the first edge of the base structure, wherein the second paddle structure is configured to pivot relative to the base structure via the second fastener.

2. The foot exercise device of claim 1, wherein the first paddle structure is configured to be moved by the first forefoot towards the first heel of the user to shorten a distance between the first forefoot and the first heel and to increase a height of an arch of the user.

3. The foot exercise device of claim 1, wherein the first paddle structure is configured to be moved by the first forefoot without toes of the user contacting the foot exercise device.

4. The foot exercise device of claim 1, wherein the first paddle structure is configured to be moved by the first forefoot to strengthen plantar fascia of the user.

5. The foot exercise device of claim 1, wherein the substantially flat upper surface comprises a frictional horizontal surface configured to contact a bottom surface of the first heel or the second heel of the user.

6. The foot exercise device of claim 1 further comprising a block structure coupled to the base structure, wherein the block structure is configured to be placed against a corresponding vertical surface to prevent the base structure from moving.

7. The foot exercise device of claim 1, wherein an upper surface of the first paddle structure comprises:

a first distal area that has a wider surface area configured to interface with a wider distal lower surface area of the first forefoot; and a second distal area that has a narrower surface area configured to interface with a narrower distal lower surface area of the first forefoot, wherein the first paddle structure is pivotably coupled to the base structure proximate the second distal area of the upper surface of the first paddle structure and proximate the first edge of the base structure.

8. The foot exercise device of claim 1, wherein the base structure forms one or more openings, wherein the first paddle structure is configured to pivot relative to the base structure via the first fastener interfacing with the one or more openings.

9. A foot exercise device comprising:

a base structure configured to remain stationary, wherein the base structure comprises a first paddle structure and a second paddle structure, the first paddle structure and the second paddle structure comprising a corresponding frictional horizontal surface configured to contact a corresponding bottom surface of a corresponding forefoot of a user; and a heel cup movably coupled to the base structure proximate an edge of the base structure, wherein the heel cup is configured to be moved in a first plane by a heel of the user while the base structure remains stationary in a second plane that is approximately parallel to the first plane and the corresponding forefoot of the user remains stationary on the first paddle structure or the second paddle structure of the base structure, wherein the foot exercise device comprises a frictional horizontal surface configured to contact a bottom surface of the heel of the user.

10. The foot exercise device of claim 9, wherein the heel cup is configured to be moved by the heel towards the corresponding forefoot of the user to shorten a distance between the corresponding forefoot and the heel and to increase a height of an arch of the user.

11. The foot exercise device of claim 9, wherein the heel cup is configured to be moved by the heel without toes of the user contacting the foot exercise device.

12. The foot exercise device of claim 9, wherein the heel cup is configured to be moved by the heel to strengthen plantar fascia of the user.

13. The foot exercise device of claim 9, wherein the frictional horizontal surface of the first paddle structure comprises:

a first distal area that has a wider surface area configured to interface with a wider distal lower surface area of the corresponding forefoot; and a second distal area that has a narrower surface area configured to interface with a narrower distal lower surface area of the corresponding forefoot.

14. The foot exercise device of claim 9, wherein the heel cup comprises a vertical surface configured to contact a rear surface of the heel.

15. The foot exercise device of claim 9 further comprising a block structure coupled to the base structure, wherein the block structure is configured to be placed against a vertical surface to prevent the base structure from moving.

16. The foot exercise device of claim 9 further comprising one or more fasteners, wherein the base structure forms one or more openings, wherein the heel cup is configured to pivot or move translationally relative to the base structure via the one or more fasteners interfacing with the one or more openings.

* * * * *